US008572880B2

(12) United States Patent
Bender

(10) Patent No.: US 8,572,880 B2
(45) Date of Patent: Nov. 5, 2013

(54) FIREARM TRIGGER GROUP

(76) Inventor: Terrence Dwight Bender, Minneapolis, MN (US)

( * ) Notice: Subject to any disclaimer, the term of this patent is extended or adjusted under 35 U.S.C. 154(b) by 2 days.

(21) Appl. No.: 13/352,965

(22) Filed: Jan. 18, 2012

(65) Prior Publication Data

US 2012/0180356 A1 Jul. 19, 2012

Related U.S. Application Data

(60) Provisional application No. 61/461,434, filed on Jan. 18, 2011, provisional application No. 61/462,263, filed on Jan. 31, 2011, provisional application No. 61/465,241, filed on Mar. 16, 2011.

(51) Int. Cl.
*F41A 19/42* (2006.01)

(52) U.S. Cl.
USPC ..... 42/69.01; 42/69.03

(58) Field of Classification Search
USPC ..... 42/69.01–69.03, 20, 42.03, 45, 42.01; 89/27.3, 147
See application file for complete search history.

(56) References Cited

U.S. PATENT DOCUMENTS 4,310,981 A * 1/1982 Waddell ..... 42/42.01
5,463,829 A * 11/1995 Sprangers ..... 42/42.01
5,881,485 A 3/1999 Milazzo
5,904,132 A 5/1999 Biller
6,615,527 B1 * 9/2003 Martin ..... 42/69.03
6,722,072 B1 4/2004 McCormick
7,162,824 B1 1/2007 McCormick
7,188,561 B1 3/2007 Kelbly
7,293,385 B2 11/2007 McCormick
7,331,136 B2 2/2008 Geissele
7,600,338 B2 10/2009 Geissele
7,661,220 B2 2/2010 Crandall et al.
7,854,084 B1 12/2010 Rutherford
2008/0010889 A1 * 1/2008 Metzger et al. ..... 42/69.01
2009/0183414 A1 7/2009 Geissele
2010/0281739 A1 11/2010 Geissele

OTHER PUBLICATIONS

Priority U.S. Appl. No. 61/461,434, filed Jan. 18, 2011; Inventor: Terrence D. Bender.
Priority U.S. Appl. No. 61/462,263, filed Jan. 31, 2011; Inventor: Terrence D. Bender.
Priority U.S. Appl. No. 61/465,241, filed Mar. 16, 2011; Inventor: Terrence D. Bender.
Zediker, Glenn, AR15 Triggers, Zediker Publishing, 2007, pp. 1-3.
http://www.snipershide.com/forum/ubbthreads.
php?ubb=showthreaded&Number=501733, Jan. 26, 2012.

(Continued)

*Primary Examiner* — Michelle (Shelley) Clement
*Assistant Examiner* — John D Cooper
(74) *Attorney, Agent, or Firm* — Vidas, Arrett & Steinkraus, P.A.

(57) ABSTRACT

In at least one embodiment, a firearm trigger group comprises a trigger arranged to pivot on a trigger axis and a hammer arranged to pivot on a hammer axis. A hammer biasing member is arranged to bias the hammer in a predetermined rotational direction. A secondary biasing member is also arranged to bias the hammer. The hammer is moveable from a first position to a second position upon actuation of the trigger. The secondary biasing member counteracts the hammer biasing member in the first position, and cooperates with the hammer biasing member in the second position.

20 Claims, 17 Drawing Sheets

(56) References Cited

OTHER PUBLICATIONS http://www.compasslake.com/trigger.htm, Jan. 26, 2012.
http://www.jprifles.com/1.4.8.1_ezt.php, Jan. 26, 2012.
http://cmmginc.secure-mall.com/item/CMMG-Two-Stage-Trigger-1504, Jan. 26, 2012.
http://shopwilsoncombat.com/Tactical-Trigger-Unit-Single-Stage-Semi-Auto/productinfo/TR-TTU/?gclid=CP6b79SY8aYCFYQUKgodTRRBBg, Jan. 26, 2012.
http://geissele.com/index.aspx, Jan. 26, 2012.
http://www.midwayusa.com/product/709049/jewell-trigger-assembly-ar-15-small-pin-154-two-stage-matte, Jan. 26, 2012.
http://www.jardinc.com/index.php?option=com_content&view=article&id=12:ar-le&catid=18:ar-15-single-stage&Itemid=6, Jan. 26, 2012.
Schematic drawing, Gun Assy, BFG-50A, Serbu Firearms, Inc., Apr. 25, 2011, p. 1.

* cited by examiner

FIREARM TRIGGER GROUP

CROSS-REFERENCE TO RELATED APPLICATIONS

This application claims the benefit of U.S. Patent Application No. 61/461,434, filed Jan. 18, 2011; U.S. Patent Application No. 61/462,263, filed Jan. 31, 2011; and U.S. Patent Application No. 61/465,241, filed Mar. 16, 2011, the entire disclosures of which are hereby incorporated herein by reference.

BACKGROUND OF THE INVENTION

This invention relates generally to firearms and more specifically to a firearm trigger group.

Firearms are known in the art, and include the "AR" type weapons such as the AR15, AR10, M16, etc. Assault-type firearms tend to employ a relatively high trigger pull force to achieve weapon firing, for example seven pounds of force. In some cases, a lighter trigger pull weight is desirable, such as when sniping or any other condition where a high degree of control is desired.

In some cases, a better trigger feel is desired. Any firearm having a trigger will have a given trigger feel throughout its range of motion. Some firearms can exhibit a grittiness in the pull, for example due to non-uniformities in sear surfaces of the trigger assembly. Over time, non-uniformities can become more pronounced and cause washboarding. This causes difficulties in knowing the exact trigger positioning to achieve firing of the weapon.

Some prior art solutions have tried reducing internal forces of the trigger group in order to achieve a reduced trigger pull; however, reduced hammer force has resulted in hang fires.

There remains a need for trigger solutions capable of providing low trigger pull weights while still providing sufficient hammer force within the trigger group. There remains a need for such trigger solutions sized appropriately to be used in the standard AR-spec lower receiver.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm trigger group comprises a trigger arranged to pivot on a trigger axis and a hammer arranged to pivot on a hammer axis. A hammer biasing member is arranged to bias the hammer in a predetermined rotational direction. A secondary biasing member is also arranged to bias the hammer. The hammer is moveable from a first position to a second position upon actuation of the trigger. The secondary biasing member counteracts the hammer biasing member in the first position, and cooperates with the hammer biasing member in the second position.

In some embodiments, a firearm trigger group comprises a trigger arranged to pivot on a trigger axis and a hammer arranged to pivot on a hammer axis. The trigger defines a trigger sear, wherein a distance from the trigger axis to the trigger sear defines a trigger moment arm $R_t$. The hammer defines a hammer sear, wherein a distance from the hammer axis to the hammer sear defines a hammer moment arm $R_h$. A ratio of $R_t/R_h$ is less than 2.

In some embodiments, a firearm trigger group is further sized to fit into a standard AR-spec lower receiver. In some embodiments, the trigger axis and the hammer axis are arranged according to standard AR-type lower receiver specifications.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
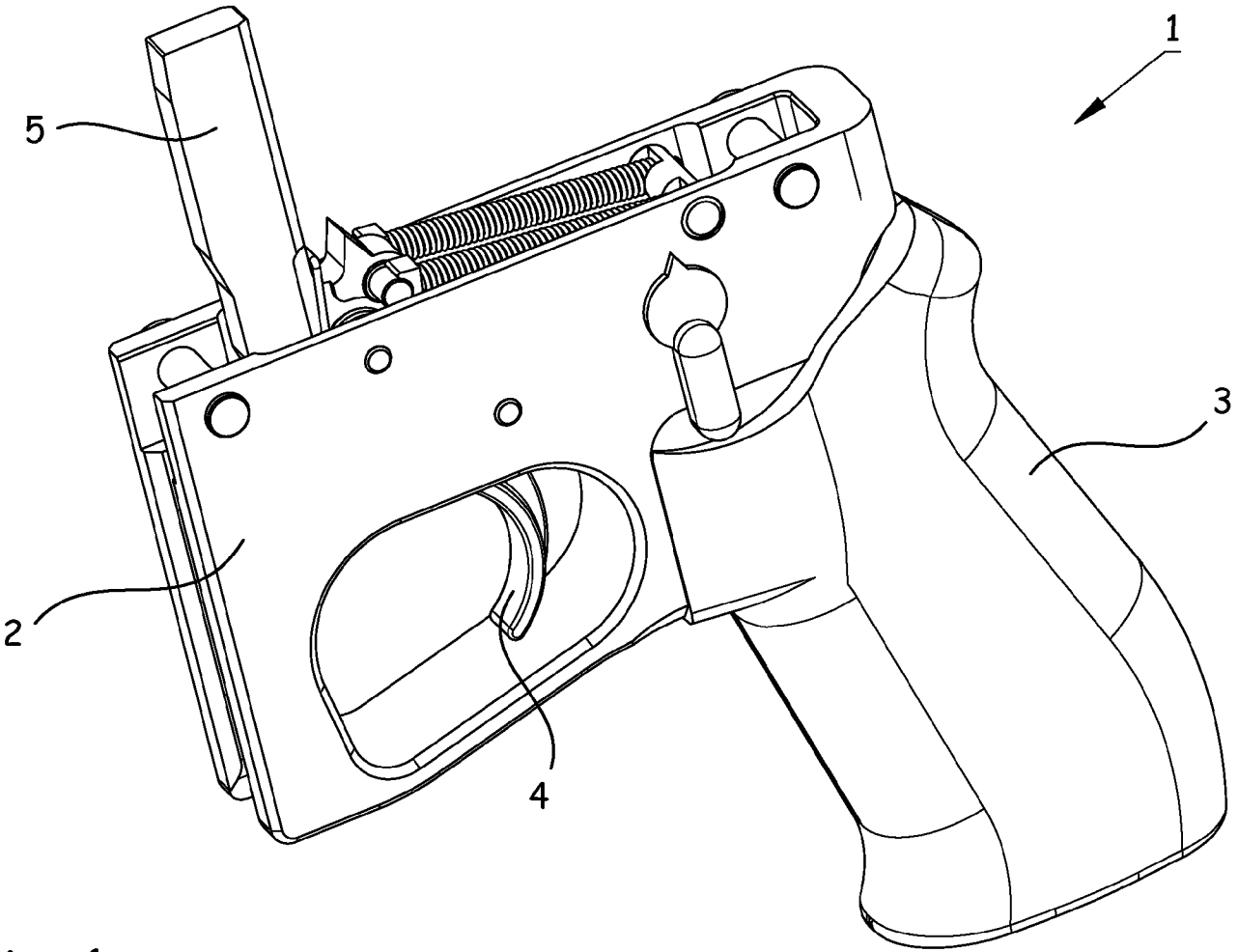
FIG. 1 shows an embodiment of an inventive trigger group in a housing.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a trigger group 1 supported by a housing 2. A grip 3 is shown for reference. A trigger group 1 desirably comprises a trigger 4 and a hammer 5.

Figure 2:
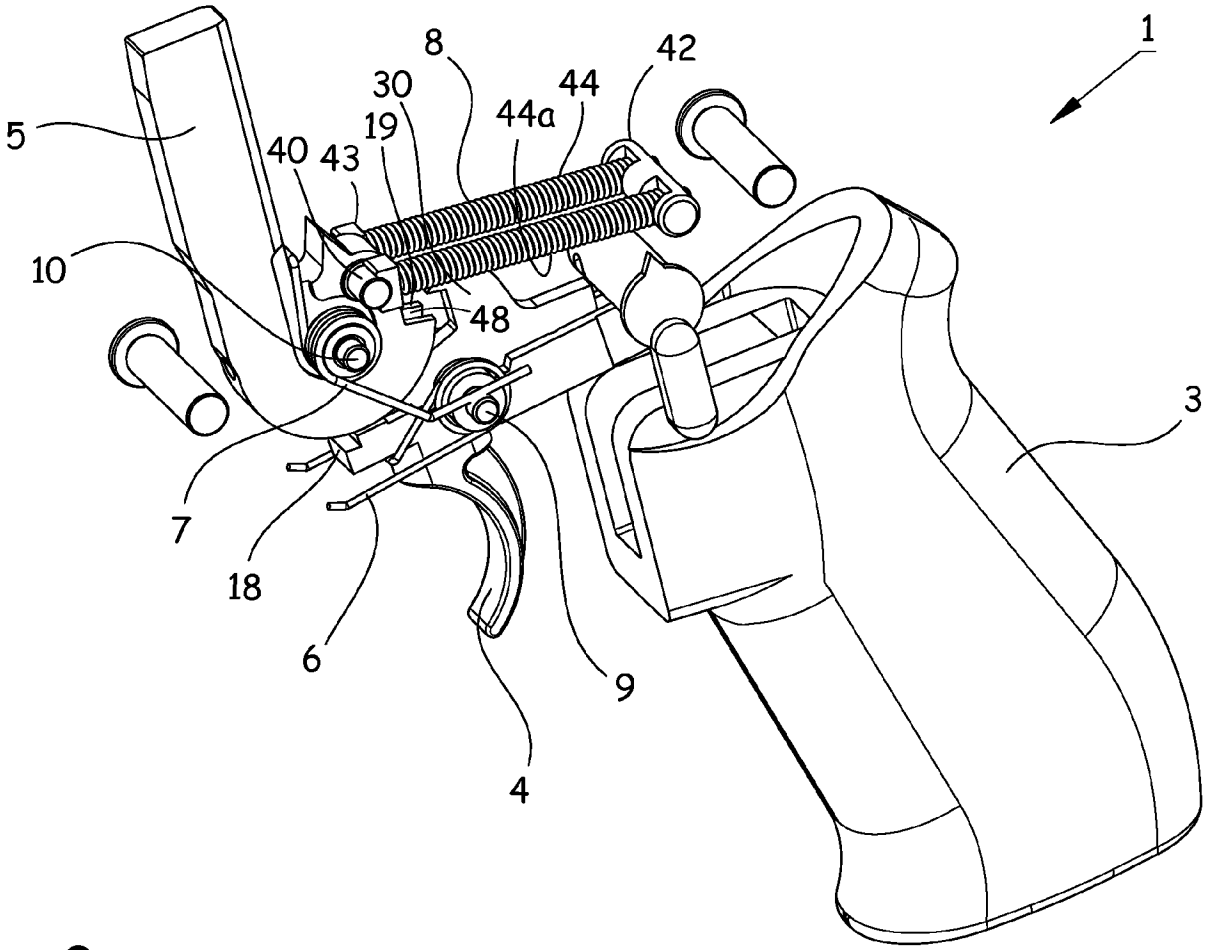
FIG. 2 shows another view of the trigger group of FIG. 1.

FIG. 2 shows the trigger group 1 of FIG. 1 with the housing 2 removed. Desirably, a trigger group 1 comprises a trigger 4 arranged to pivot on a trigger axis and a hammer 5 arranged to pivot on a hammer axis. In some embodiments, the trigger 4 is supported by a trigger pin 9, wherein a central axis of the trigger pin defines the trigger axis. In some embodiments, the hammer 5 is supported by a hammer pin 10, wherein a central axis of the hammer pin defines the hammer axis. The trigger pin 9 and hammer pin 10 are supported by the housing 2. In some embodiments, the trigger pin 9 and hammer pin 10 are sized and arranged according to standard AR-10 or AR-15 dimensions, and will fit into a standard AR lower receiver.

The trigger group 1 further comprises a trigger biasing member 6 arranged to bias the trigger 4 in a predetermined rotational direction. In some embodiments, said trigger biasing member 6 comprises a torsion spring. The trigger group 1 further comprises a hammer biasing member 7 arranged to bias the hammer 5 in a predetermined rotational direction. In some embodiments, said hammer biasing member 7 comprises a torsion spring.

Desirably, the trigger 4 comprises a trigger sear 18 and the hammer 5 comprises a hammer sear 19. In at least one orientation of the trigger group 1, the trigger sear 18 contacts the hammer sear 19, wherein the trigger 4 is oriented to prevent rotation of the hammer 5.

In some embodiments, the trigger group 1 further comprises a secondary biasing member 8 arranged to apply a force to said hammer 5. Desirably, a secondary biasing member 8 applies a force to said hammer 5 at multiple orientations of said hammer 5. In some embodiments, the a secondary biasing member 8 applies a force that cooperates with the hammer biasing member 7 in at least one orientation, and applies a force that counteracts the hammer biasing member 7 in at least one other orientation.

Desirably, the secondary biasing member 8 comprises a spring 44. In some embodiments, the secondary biasing member 8 comprises a coil spring. In some embodiments, the secondary biasing member 8 comprises a compression spring.

Figure 3:
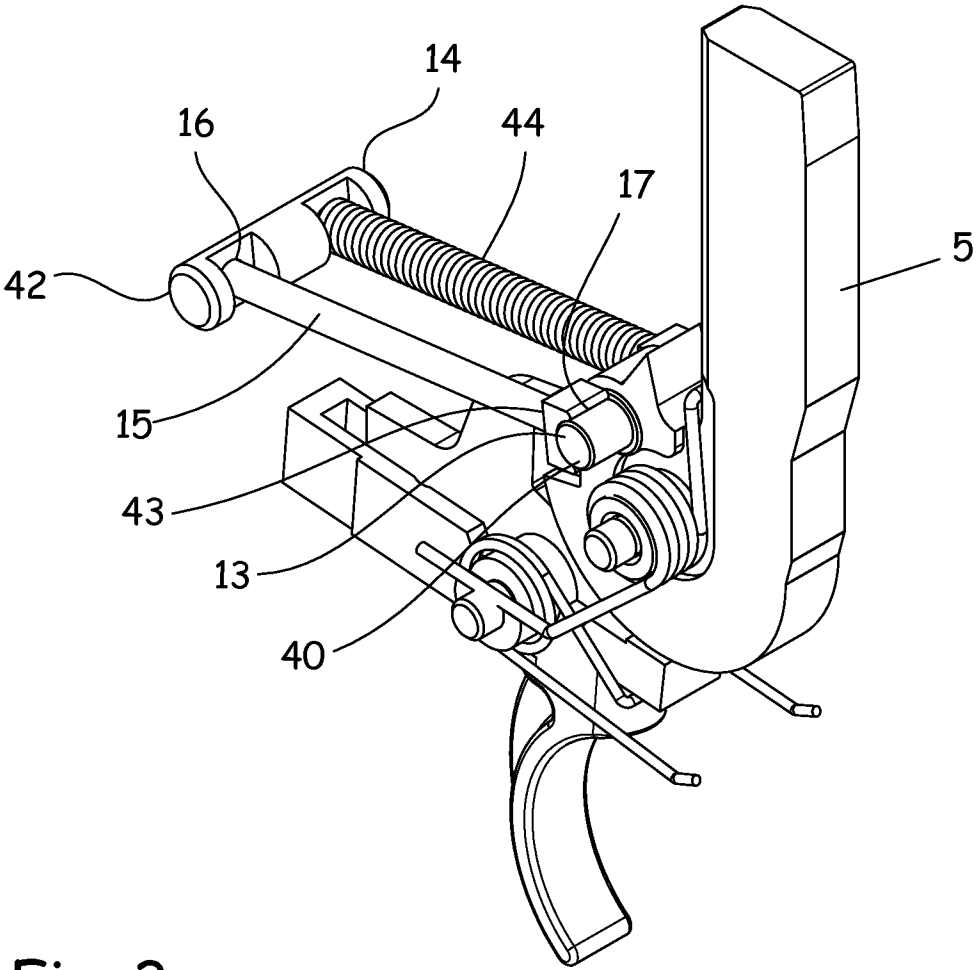
FIG. 3 shows another view of the trigger group of FIG. 1.

FIG. 3 shows another view of an embodiment of the trigger group 1, wherein a spring has been removed from the secondary biasing member 8 for illustrative purposes. Desirably, a first portion 40 of the secondary biasing member 8 is pivotally engaged to the hammer 5. In some embodiments, the secondary biasing member 8 comprises a drive pin 13 that is pivotally attached to the hammer 5. Desirably, a second portion 42 of the secondary biasing member 8 is engaged to a support. In the embodiment of FIGS. 2 and 3, the second portion 42 is pivotally supported by the housing 2 (see FIG. 1). In some embodiments, the second portion 42 comprises a seat member 14 that engages the spring 44. In some embodiments, the housing 2 pivotally supports the seat member 14.

The spring(s) 44 desirably transmit force between the first portion 40 and second portion 42 of the secondary biasing member 8. In some embodiments, the secondary biasing member 8 further comprises a mounting shaft 15 extending between the first portion 40 and second portion 42. In some embodiments, the mounting shaft 15 is positioned within the spring 44. When the spring 44 comprises a compression spring, the mounting shaft 15 can provide bracing against buckling. In some embodiments, the mounting shaft 15 is arranged to pivotally engage a portion of a drive pin 13. In some embodiments, an end of a mounting shaft 15 comprises a semicircular shape arranged to abut a semicircular surface of the drive pin 13. The mounting shaft 15 can further comprise a flange 43 that a spring 44 bears against.

In some embodiments, the seat member 14 comprises an aperture 16, and a portion of the mounting shaft 15 passes through the aperture 16. Thus, in some embodiments, compressive force supplied by the spring 44 retains the secondary biasing member 8 in place. In the embodiment of FIGS. 2 and 3, the spring 44 is compressed between the seat member 14 and the flange 43 of the mounting shaft 15.

Figure 4:
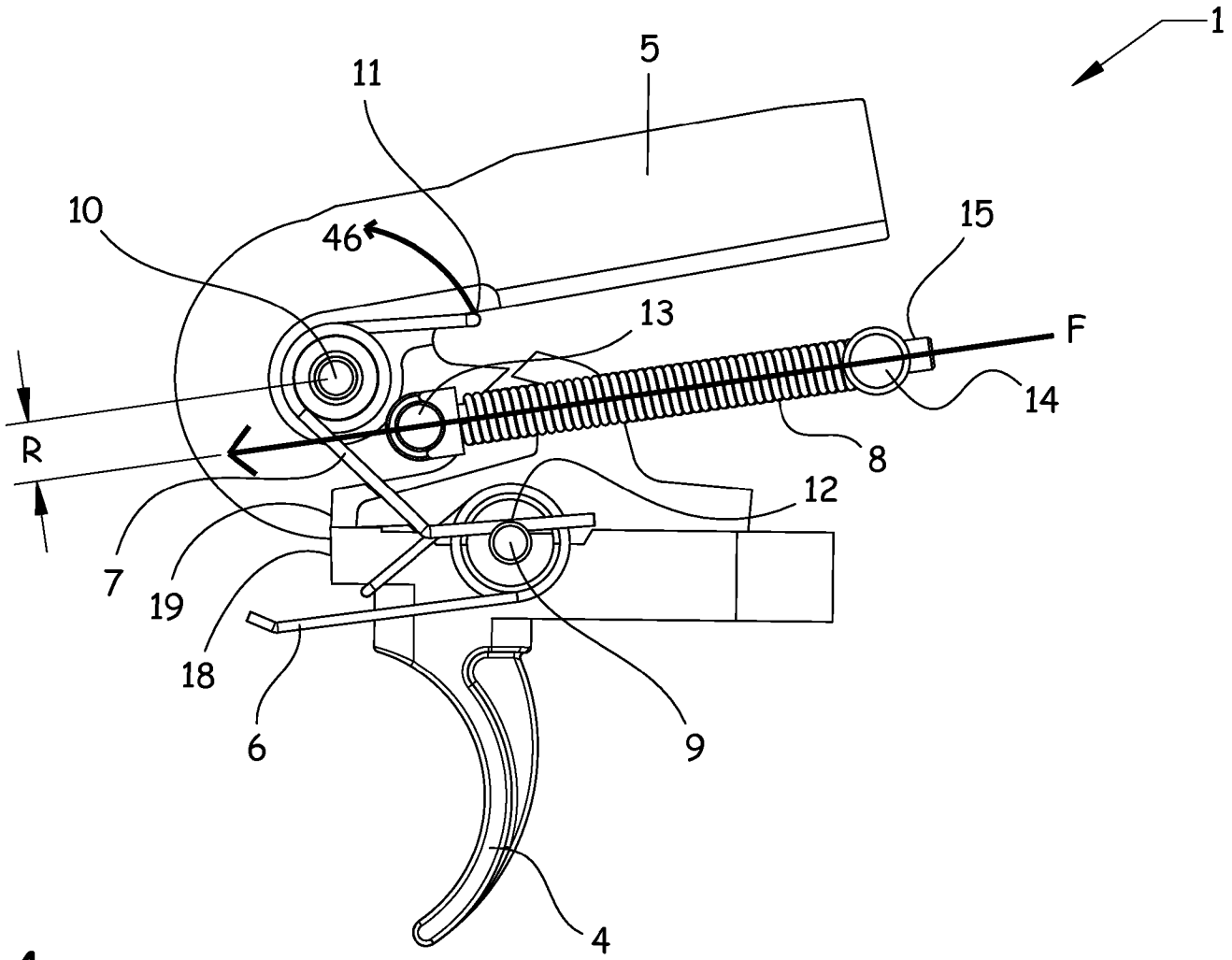
FIGS. 4-6 show side views of an embodiment of a trigger group at different orientations.
Figure 5:
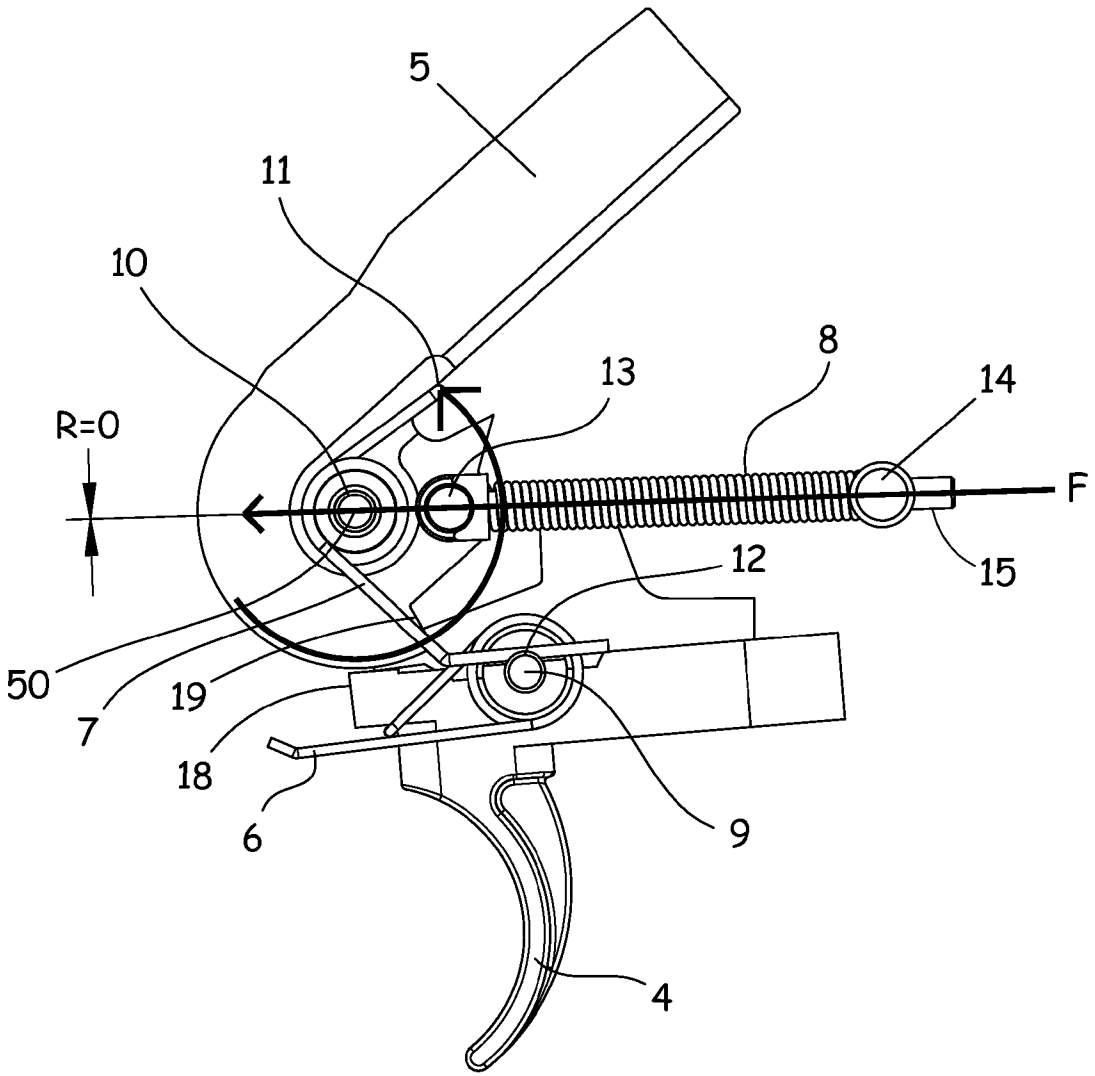
Figure 6:
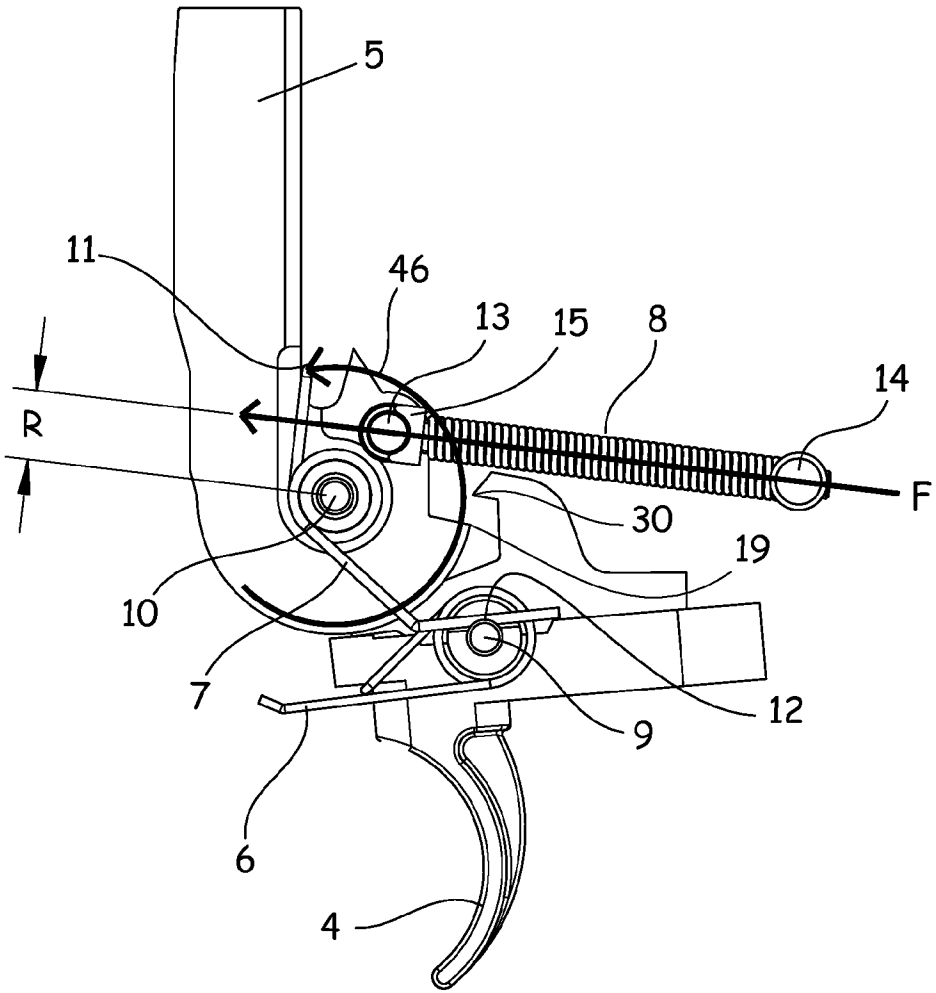

FIGS. 4-6 show an embodiment of a trigger group 1 at three different orientations. These views help show how the secondary biasing member 8 applies forces to the hammer 5.

FIG. 4 shows the trigger group 1 in a cocked orientation, wherein the trigger sear 18 contacts the hammer sear 19. In this orientation, the trigger sear 18 is in an interference position that prevents rotation of the hammer 5. The hammer biasing member 7 places a rotational force 46 upon the hammer 5. The secondary biasing member 8 places a force F upon the hammer 5, resulting in a moment equal to the magnitude of the force F times the moment arm R. In the orientation of FIG. 4, the secondary biasing member 8 applies a rotational force to the hammer 5 in the opposite direction of the rotational force 46 supplied by the primary hammer baising member 7—thus the secondary biasing member 8 is arranged to counteract the primary hammer baising member 7. This ultimately reduces the friction between the trigger sear 18 and hammer sear 19, and reduces the amount of force required to depress the trigger 4 to fire the weapon.

FIG. 5 shows the trigger group 1 after the trigger 4 has been depressed, moving the trigger sear 18 such that it has released the hammer sear 19, and the hammer 5 has rotated about the hammer axis 50. In this orientation, the force F applied by the secondary biasing member 8 passes through the hammer axis 50 and does not place rotational forces on the hammer 5. In this orientation, the secondary biasing member 8 is shifting from counteracting the primary hammer baising member 7 to cooperating with the primary hammer baising member 7. In some embodiments, the secondary biasing member 8 comprises a toggle-over-center device, and FIG. 5 represents the centered transitional orientation.

FIG. 6 shows the trigger group 1 with the hammer 5 rotated past the orientation shown in FIG. 5. The secondary biasing member 8 now places rotational forces upon the hammer 5 that cooperate with the primary hammer baising member 7. Thus, the secondary biasing member 8 now applies additional force to the hammer 5, thereby adding energy to the hammer 5 to help ensure proper firing of ammunition.

Figure 7:
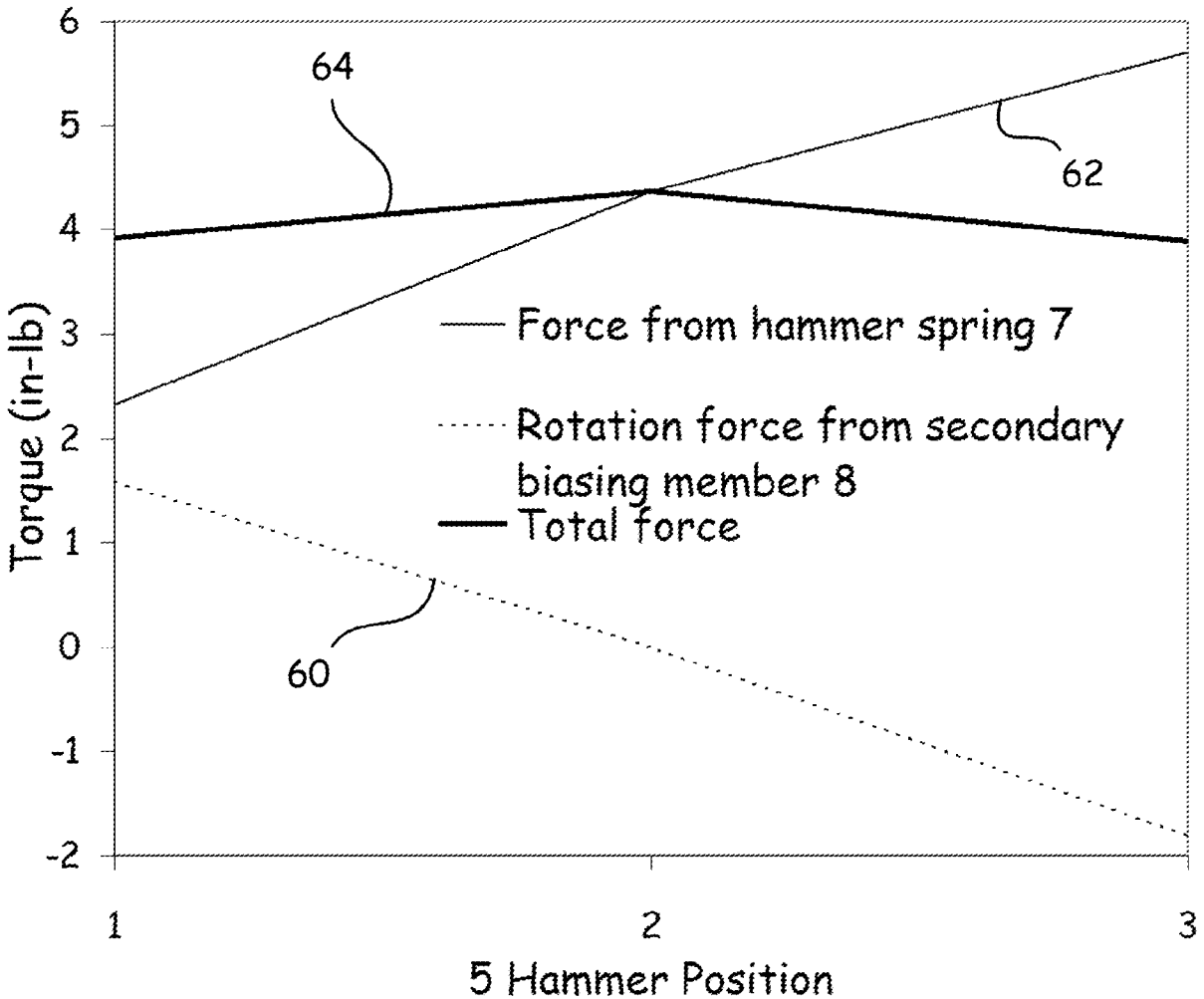
FIG. 7 shows a graph comparing forces placed upon a hammer

FIG. 7 shows a graph that shows the torque 60 applied by the secondary biasing mechanism 8 to the hammer 5; the torque 62 applied by the primary hammer biasing member 7; and the total torque 64 (torque 60 applied by the secondary biasing mechanism 8 plus torque 62 applied by the primary hammer biasing member 7). Hammer position 1 on the graph represents the orientation of FIG. 6, hammer position 2 represents the orientation of FIG. 5 and hammer position 3 represents the orientation of FIG. 4.

In some embodiments, a secondary biasing member 8 is centered upon a hammer swing plane (i.e. a plane defined by a central axis of the hammer 5 as the hammer 5 rotates). In some embodiments, a central longitudinal axis of the secondary biasing member 8 is oriented in the hammer swing plane.

In some embodiments, a secondary biasing member 8 comprises multiple members that are balanced on opposite sides of the hammer swing plane. For example, a secondary biasing member 8 can comprise a first spring 44 and a second spring **44*a*, wherein the first and second springs 44, 44*a* are oriented similar distances from a hammer swing plane. Desirably, the first and second springs 44, 44*a* are similar. A secondary biasing member 8 can comprise first and second mounting shafts 15, which are balanced across the hammer swing plane. In some embodiments, portions of the secondary biasing member 8 located on a second side of the hammer swing plane are mirror images of portions of the secondary biasing member 8 located on a first side. In some embodiments, a first spring 44 is parallel to a second spring 44***a*.

Although a secondary biasing member 8 has been illustrated herein using compression springs, other embodiments can use other types of springs (e.g. tension springs) to achieve a similar result. A person of ordinary skill in the art will recognize that the second portion 42 of the secondary biasing member 8 can be relocated, and tension springs can be used.

In some embodiments, the hammer sear 19 comprises a first portion and a second portion separated by a notch 48 (see FIG. 2). In some embodiments, a disconnector 30 of the trigger group 1 passes through the notch 48 as the hammer 5 rotates. FIG. 6 shows an embodiment of a hammer 5 where the location of the hammer sear 19 might cause the hammer sear 19 to interfere with a disconnector 30—as the hammer 5 rotates past the orientation shown in FIG. 6, it can be seen how the sizing of the hammer sear 19 and disconnector 30 could result in contact. This can be solved by providing a notch 48 in the hammer sear 19.

Figure 8:
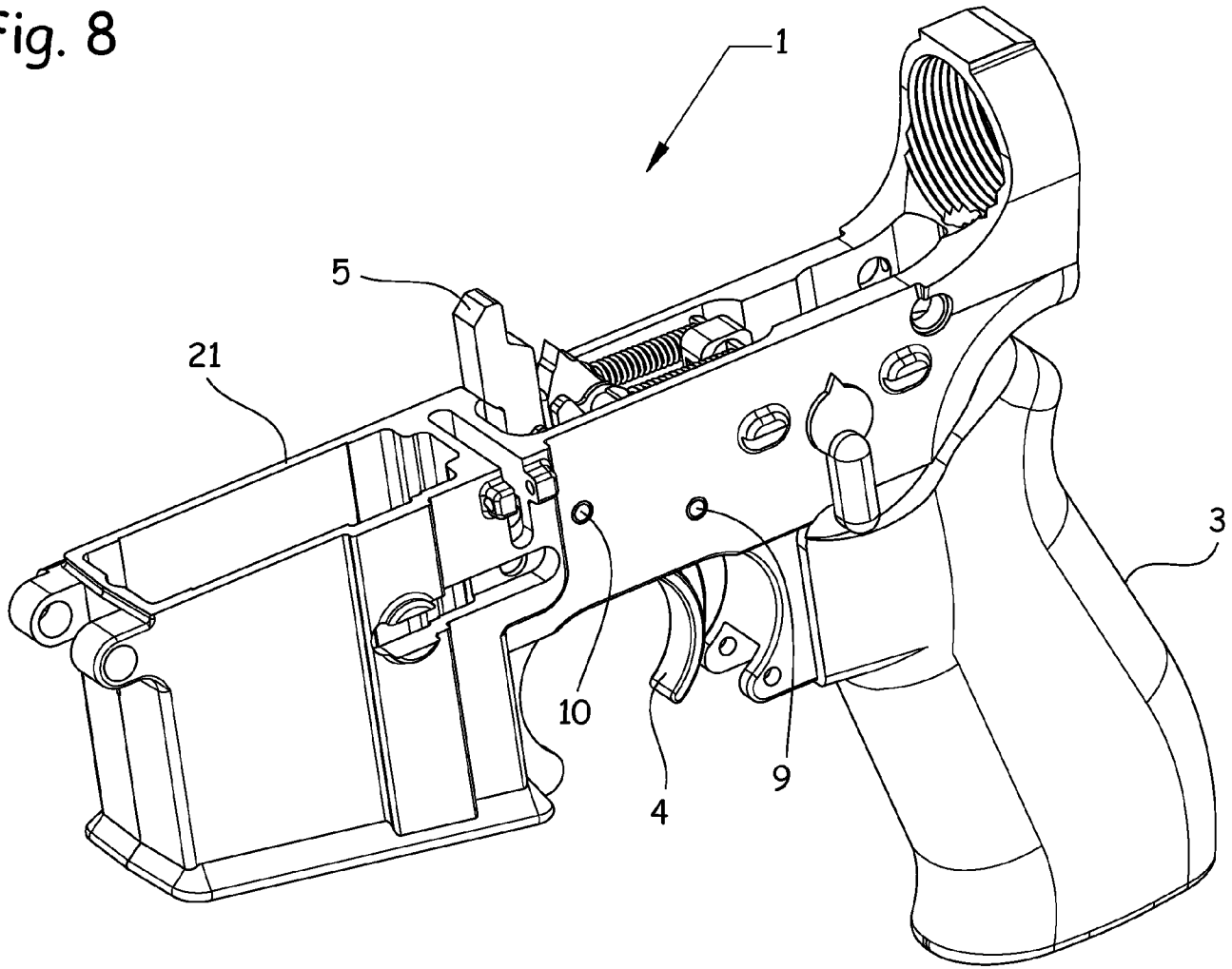
FIG. 8 shows another embodiment of an inventive trigger group in a housing.
Figure 9:
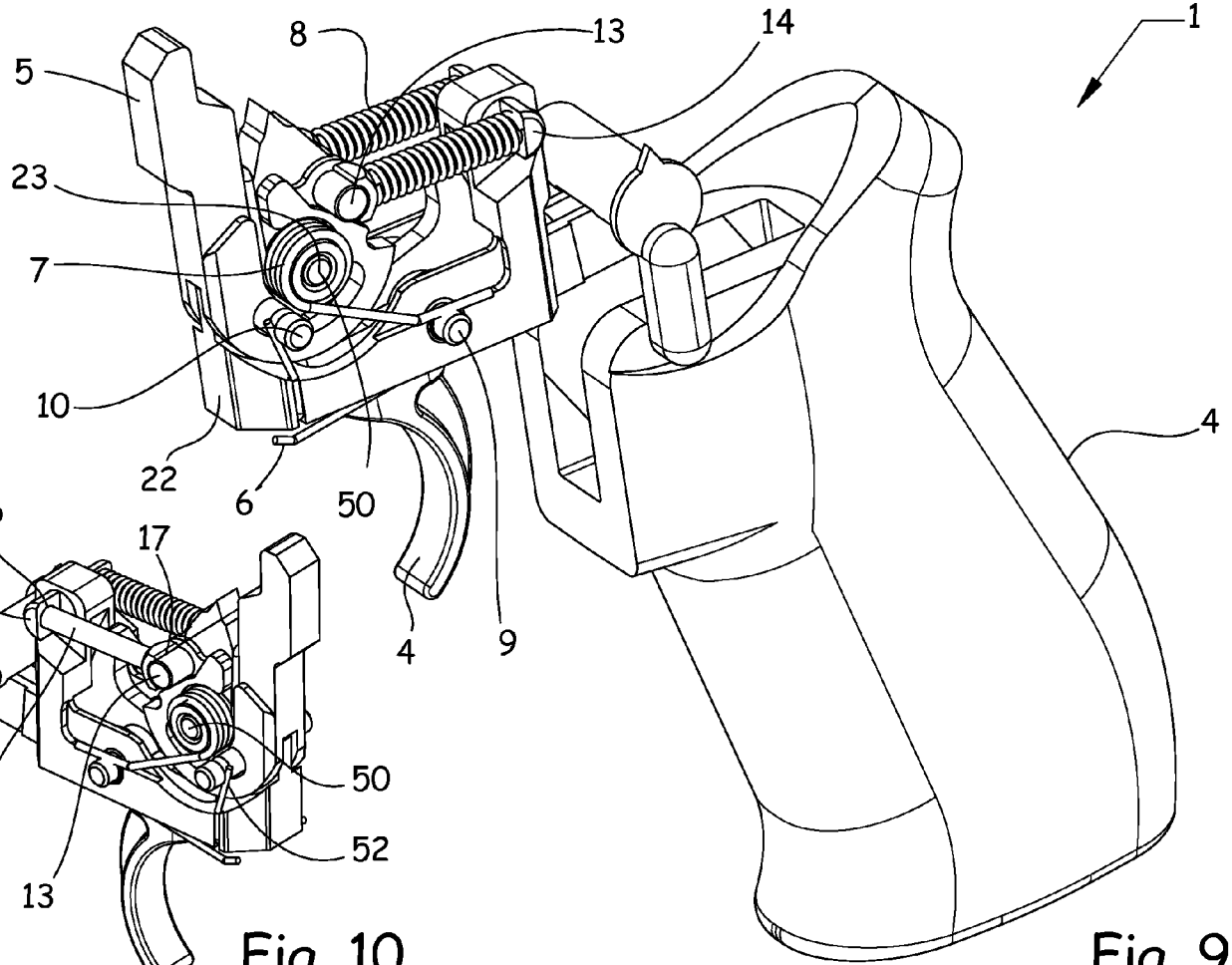
FIGS. 9 and 10 show additional views of the trigger group of FIG. 8.
Figure 10:
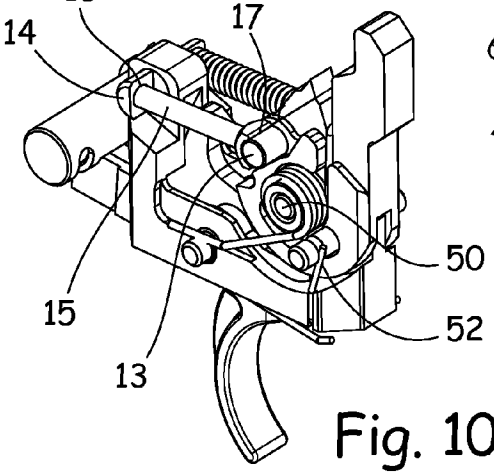
Figure 11:
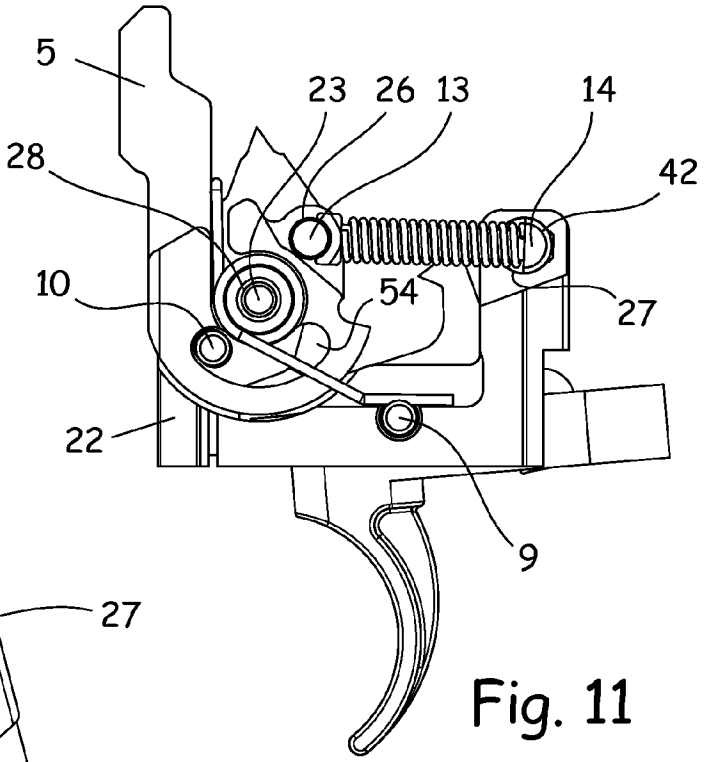
FIG. 11 shows a side view of the trigger group of FIG. 8.

FIG. 8 shows another embodiment of a trigger group 1 installed in a standard AR lower receiver 21. When sized according to standard AR specifications, the standard location and spacing of the hammer axis (e.g. 10) and trigger axis (e.g. 9) are fixed.

In some embodiments, the inventive trigger group 1 is sized to fit into a standard AR lower receiver 21, but changes the location of the hammer axis 50 from the stock location.

Referring to FIGS. 8-14, in some embodiments, a trigger pin 9 and a hammer pin 10 are located according to standard AR specifications; however, an offset hammer pin 23 is also provided, which is offset from the standard AR hammer pin location. The offset hammer pin 23 defines the hammer axis 50, and the hammer 5 rotates upon the offset hammer pin 23.

In some embodiments, the trigger group 1 comprises a frame 22. In some embodiments, the frame 22 is sized to be received in a standard AR lower receiver. In some embodiments, the frame 22 provides support for the secondary biasing member 8. In some embodiments, the frame 22 provides support for the offset hammer pin 23.

Figure 13:
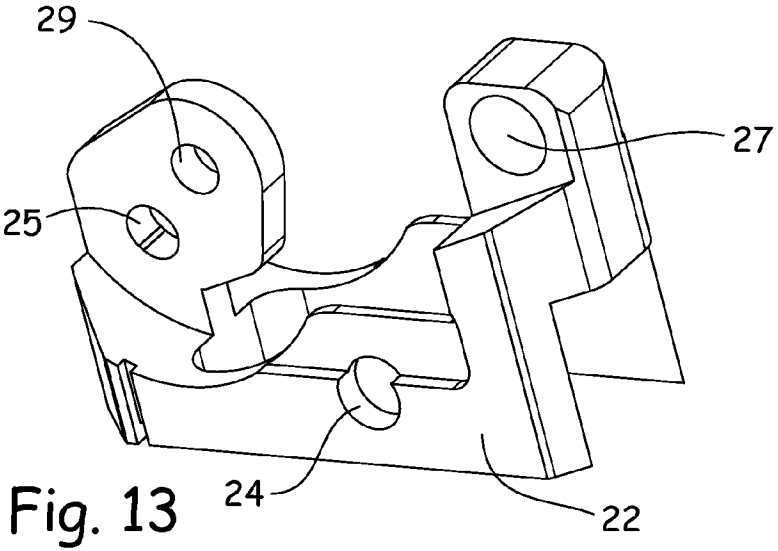
FIG. 13 shows an embodiment of a frame.

FIG. 13 shows an embodiment of a frame 22. In some embodiments, a frame 22 comprises a trigger pin aperture 24 and an engagement location 27 to engage a secondary biasing member 8. In some embodiments, the engagement location 27 comprises an aperture. In some embodiments, the frame 22 comprises a stock hammer pin aperture 25 and an offset hammer pin aperture 29.

In some embodiments, the frame 22 is supported at the trigger pin aperture 24 and the stock hammer pin aperture 25, for example by a trigger pin 9 and a hammer pin 10 arranged in the stock locations. The frame 22 supports an offset hammer pin 23, which in turn supports the hammer 5, which has been moved from the stock location. A hammer biasing member 7 is supported by the offset hammer pin 23. In some embodiments, a mounting spring 52 is provided to further secure the frame 22 to the stock location hammer pin 10 (see FIG. 10).

In some embodiments, the engagement location 27 of the frame 22 provides a pivotal connection that supports the secondary biasing member 8. In some embodiments, the engagement location 27 of the frame 22 supports the second portion 42 of the secondary biasing member 8. In some embodiments, the engagement location 27 of the frame 22 comprises an aperture that receives a seat member 14 of the secondary biasing member 8.

Figure 12:
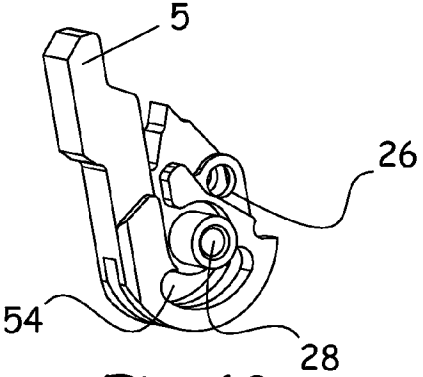
FIG. 12 shows an embodiment of a hammer.

FIG. 12 shows an embodiment of a hammer 5 suitable for use in the trigger group 1 of FIGS. 8-14.

In some embodiments, the hammer 5 comprises an engagement location 26 for engaging the secondary biasing member 8. In some embodiments, the engagement location 26 comprises an aperture suitable to receive a drive pin 13 of the secondary biasing member 8.

In some embodiments, the hammer 5 comprises a slot 54, which may have an arcuate shape. The slot 54 is desirably provided to allow clearance for the stock location hammer pin 10.

Figure 14:
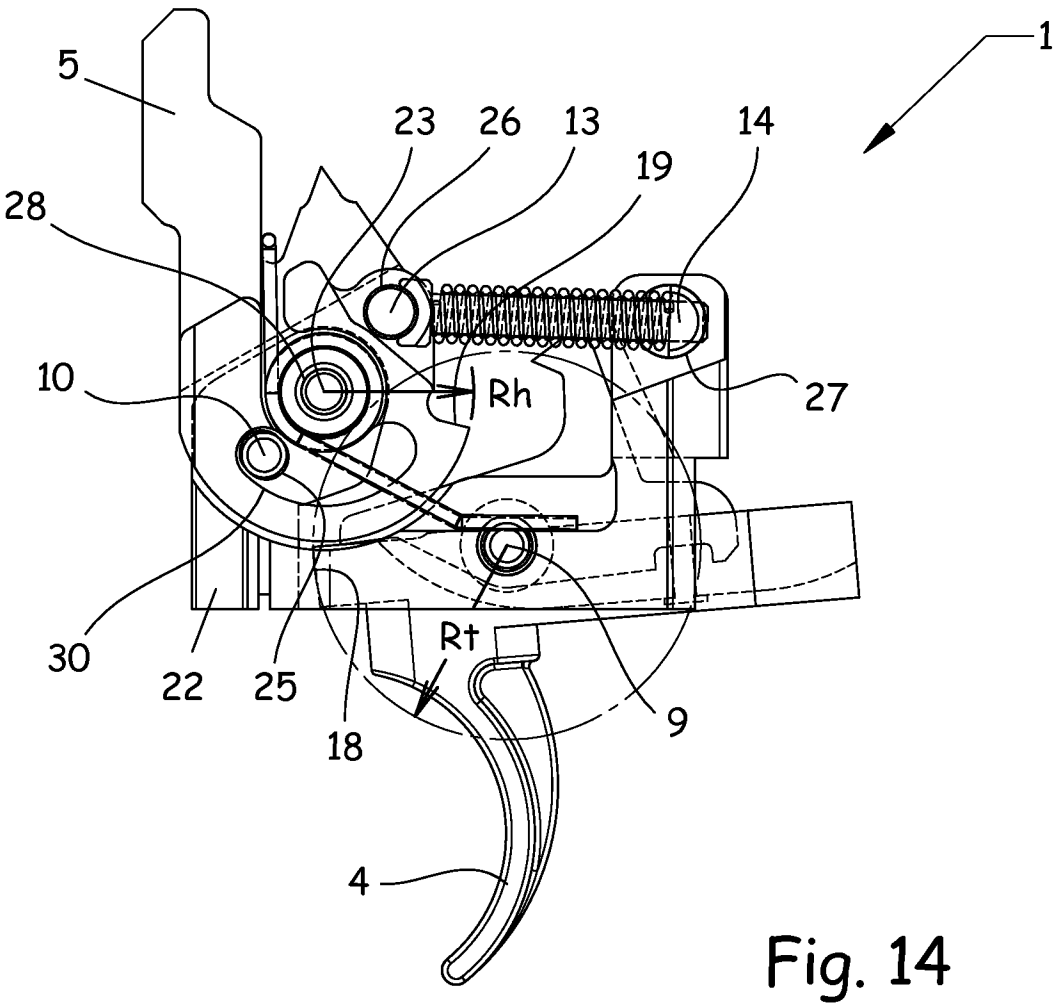
FIG. 14 shows another side view of the trigger group of FIG. 8.

FIG. 14 shows a side view of an embodiment of a trigger group 1 having the offset hammer pin 23. A trigger moment arm R, from the trigger pivot 9 to the trigger sear 18 is shown, as well as a hammer moment arm $R_h$ from the hammer pivot 23 to the hammer sear 19.

Figure 15:
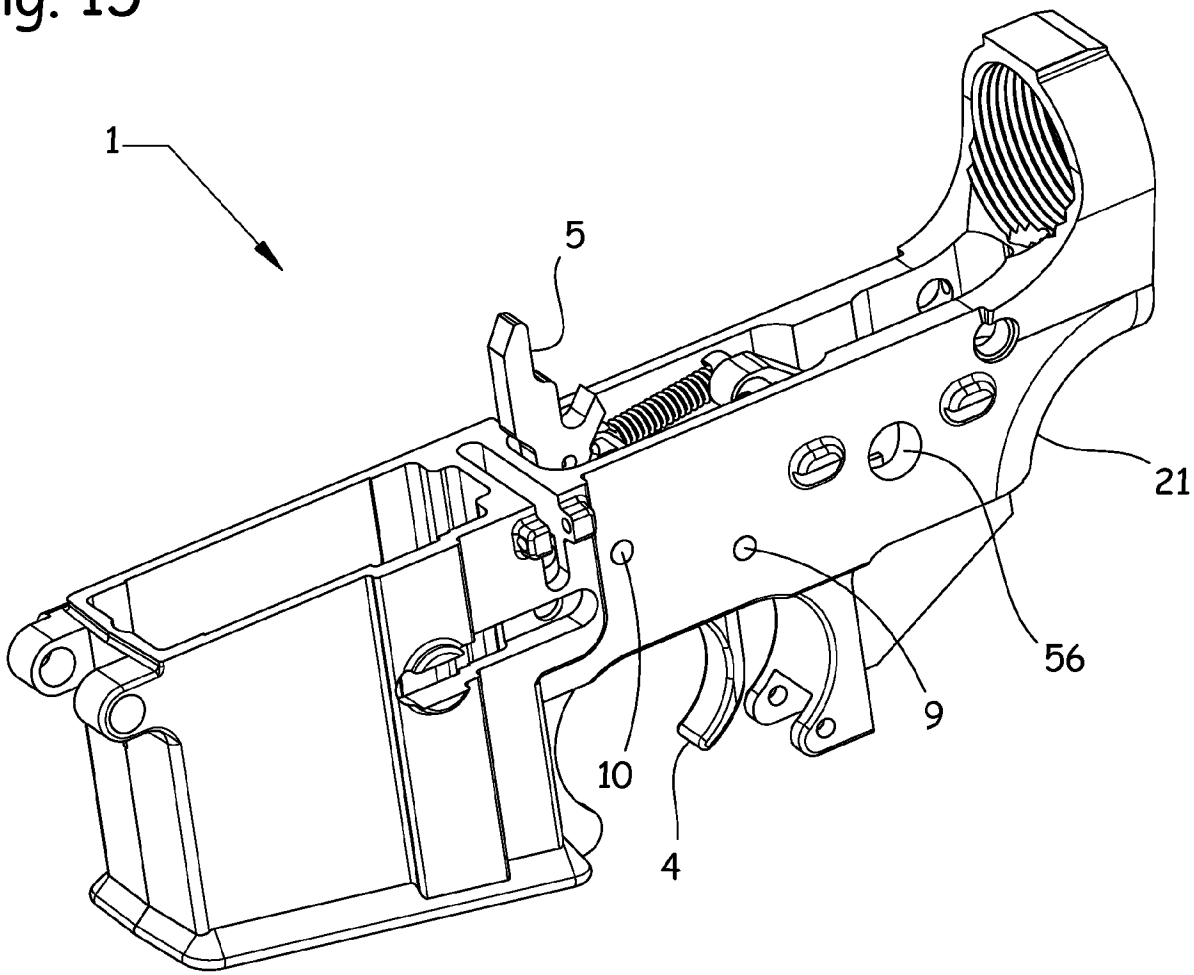
FIG. 15 shows another embodiment of an inventive trigger group in a housing.
Figure 16:
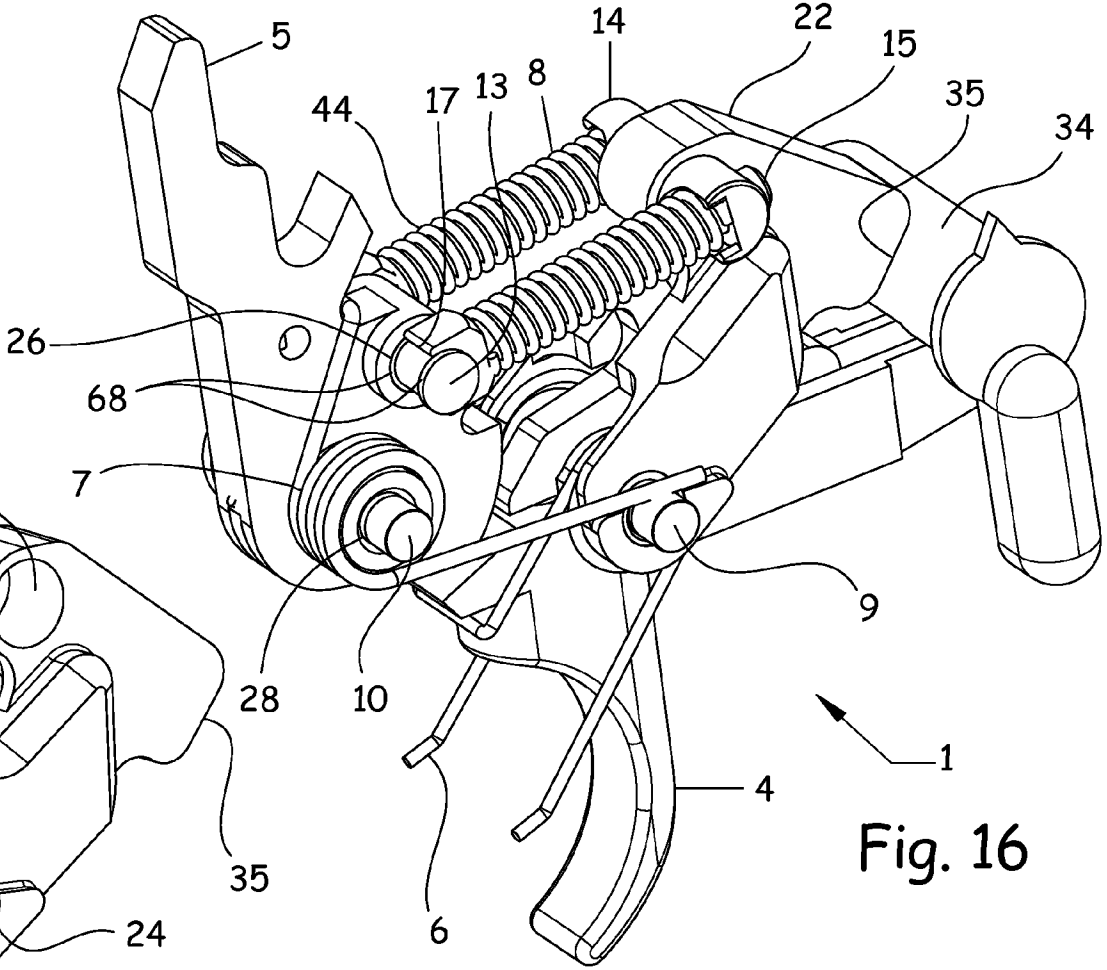
FIG. 16 shows another view of the embodiment of FIG. 15.
Figure 17:
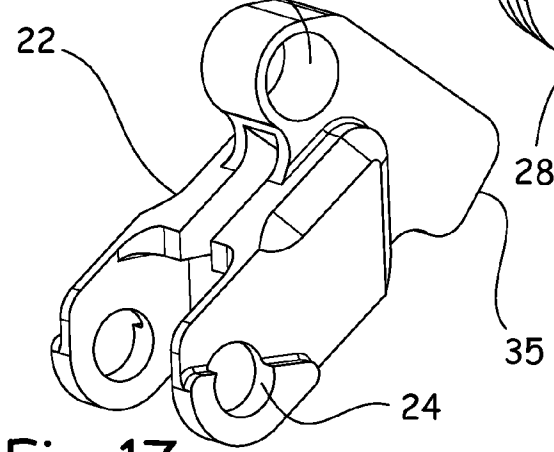
FIG. 17 shows an embodiment of a frame.

FIG. 15 shows another embodiment of a trigger group 1 oriented in a standard AR lower receiver 21. FIG. 16 shows the trigger group 1 of FIG. 15 with the standard AR lower receiver 21 removed. FIG. 17 shows an embodiment of a frame 22 included in the embodiment of FIG. 16.

In some embodiments, the trigger group 1 comprises a drop-in replacement for a standard AR-type trigger group, wherein the hammer pin 10 and trigger pin 9 are oriented in the stock AR locations and are supported by the stock AR lower receiver.

In some embodiments, the hammer 5 comprises an engagement location 26 for engaging the secondary biasing member 8. In some embodiments, the engagement location 26 comprises an aperture for receiving a drive pin 13 of the secondary biasing member 8. In some embodiments, a drive pin 13 comprises one or more flange(s) 68 oriented to prevent lateral movement of portions of the secondary biasing member 8.

In some embodiments, the trigger group 1 comprises a frame 22. In some embodiments, the frame 22 comprises a trigger pin aperture 24 and an engagement location 27 to engage a secondary biasing member 8. In some embodiments, the frame 22 is supported at the trigger pin aperture 24 by a trigger pin 9, and is further supported at a secondary support location 35. In some embodiments, the secondary support location 35 is attached to or abuts a portion of an AR lower receiver. In some embodiments, the secondary support location 35 abuts the stock AR safety mechanism 34. In some embodiments, force provided by a spring 44 of the secondary biasing member 8 forces the secondary support location 35 to abut the supporting portion (e.g. the safety 34). The safety 34 is ultimately supported by the AR lower receiver, passing through a safety aperture 56 (see FIG. 15).

Figure 18:
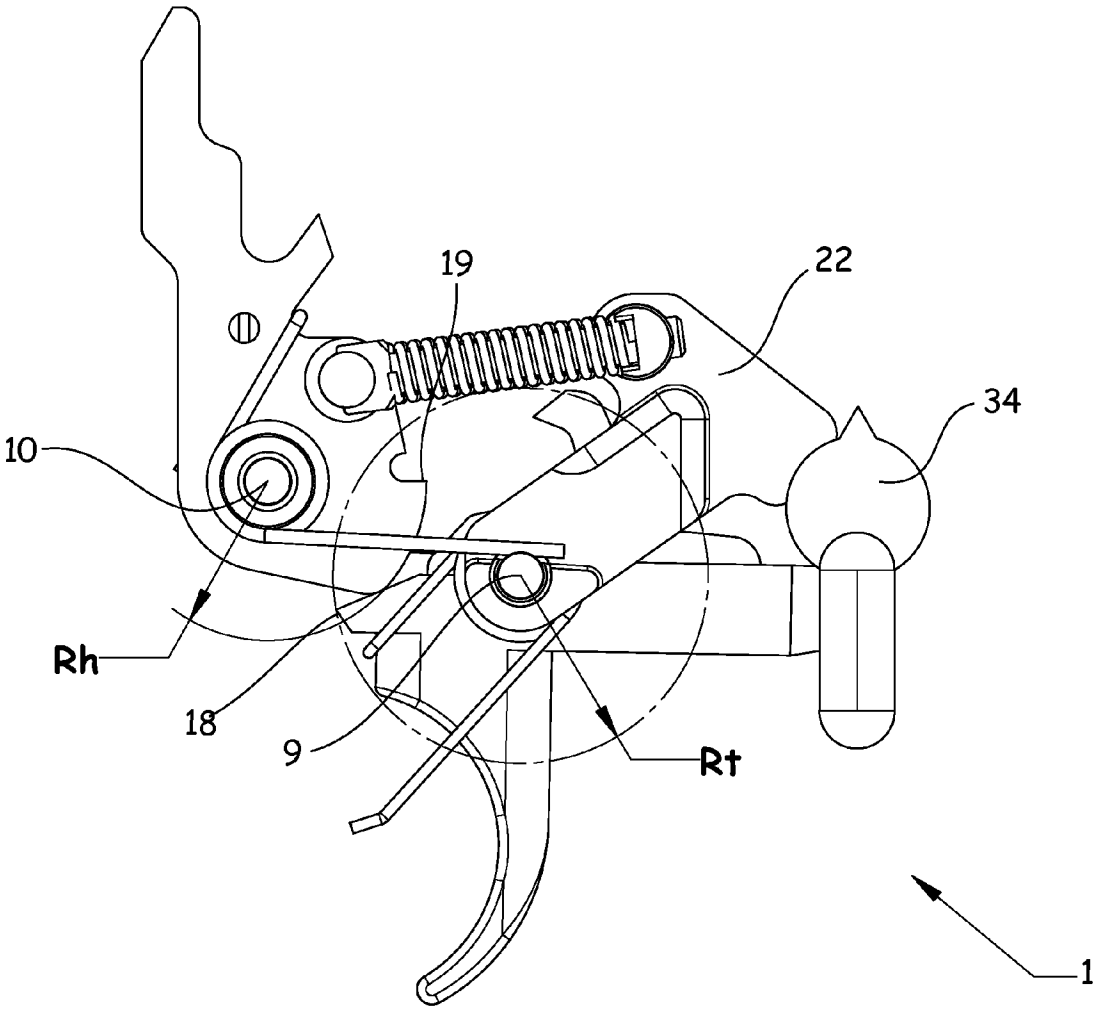
FIG. 18 shows a side view of the embodiment of FIG. 15.

FIG. 18 shows a side view of an embodiment of a trigger group 1. A trigger moment arm $R_t$ from the trigger pivot 9 to the trigger sear 18 is shown, as well as a hammer moment arm $R_h$ from the hammer pivot 23 to the hammer sear 19.

In some embodiments, the trigger group 1 is provided with multiple alternative springs 44 for the secondary biasing member 8. The springs 44 can be exchanged to provide for different trigger 4 pull weights.

Figure 19:
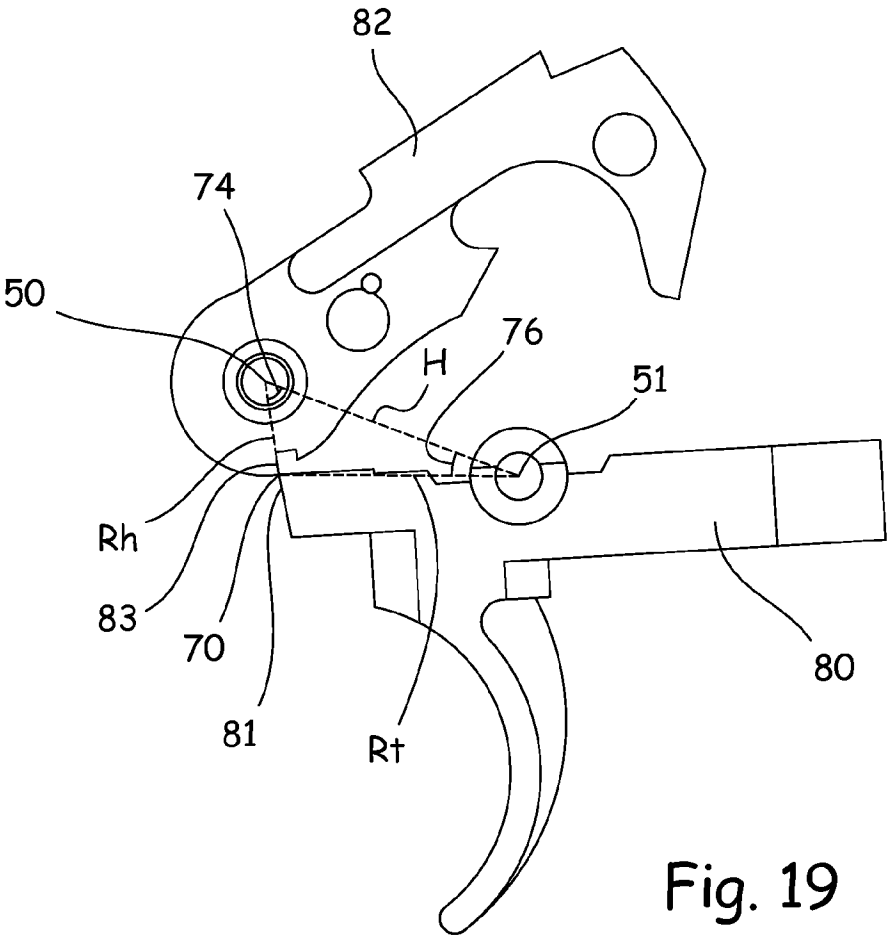
Fig. 19 Prior Art
FIG. 19 shows a side view of a PRIOR ART trigger group.

FIG. 19 depicts a PRIOR ART standard AR-15 trigger mechanism. FIG. 19 shows a trigger 80 arranged to pivot on a trigger axis 51, and a hammer 82 arranged to pivot on a hammer axis 50. The locations and spacing between the hammer axis 50 and trigger axis 51 are fixed according to predetermined standard AR lower receiver specifications. The trigger 80 defines a trigger sear 81 and the hammer 82 defines a hammer sear 83. The trigger sear 81 abuts the hammer sear 83 prior to firing the weapon.

FIG. 19 shows the sears 81, 83 just prior to release. The last point of contact between the sears 81, 83 comprises an engagement location 70. The engagement location 70 defines the moment arms associated with the trigger sear 18 and hammer sear 19. A trigger moment arm $R_t$ comprises the distance from the trigger axis 51 to the engagement location 70. A hammer moment arm $R_h$ comprises the distance from the hammer axis 50 to the engagement location 70. A reference triangle can be drawn between the hammer axis 50, trigger axis 51 and reference location 70. Because the hammer axis 50 and trigger axis 51 are fixed according to standard AR specification, the hypotenuse H of the reference triangle can also be considered a predetermined constant.

In FIG. 19, the hammer moment arm $R_h$ is approximately 0.313" and the trigger moment arm $R_t$ is approximately 0.798". A ratio of $R_t/R_h$=2.55 in the prior art trigger. A hammer interior angle 74 of the reference triangle is approximately 61 degrees. A trigger interior angle 76 of the reference triangle is approximately 20 degrees. A ratio of hammer interior angle 74/trigger interior angle 76=3.05 in the prior art trigger.

Figure 20:
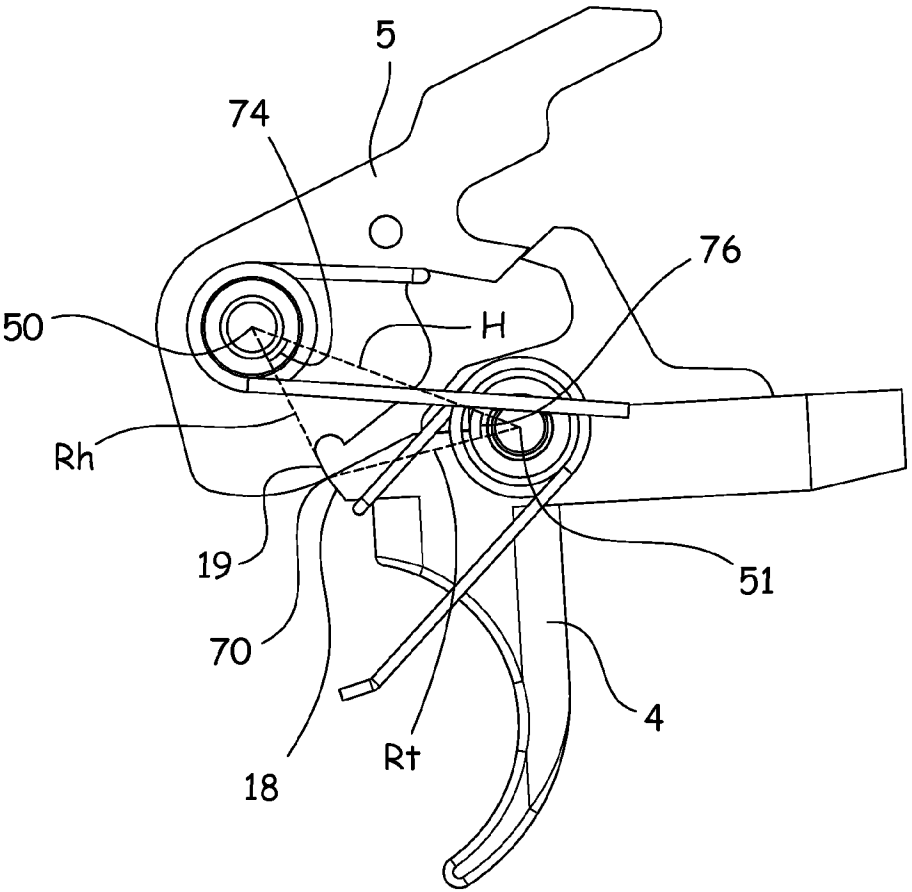
FIG. 20 shows a side view of an embodiment of an inventive trigger group.

FIG. 20 shows an embodiment of an inventive trigger group 1 at an orientation similar to the orientation of FIG. 19. The trigger axis 51 and hammer axis 50 are similar in location and spacing to FIG. 19. For the purposes of the disclosure, FIGS. 19 and 20 can be considered to have the same scale.

The engagement location 70 of the trigger sear 18 and hammer sear 19 is shown, and a reference triangle between the hammer axis 50, trigger axis 51 and reference location 70. The hypotenuse H extends between the hammer axis 50 and trigger axis 51, and is similar to the hypotenuse H of FIG. 19.

In FIG. 20, the hammer moment arm $R_h$ is approximately 0.53" and the trigger moment arm $R_t$ is approximately 0.626". Thus, the trigger group 1 of FIG. 20 reduces the trigger moment arm $R_t$ when compared to the prior art, and further increases the hammer moment arm $R_h$. This reduces the amount of force required for a shooter to depress the trigger, providing a lighter trigger pull (which can improve accuracy). Further, the design of FIG. 20 and reduces the amount of frictional engagement force between the trigger sear 18 and hammer sear 19. This reduces the negative impacts of such friction, for example reducing a feeling of grit and/or washboarding that can develop in triggers.

The embodiment of FIG. 20 has a ratio of $R_t/R_h$=approximately 1.18, as compared to the prior art $R_t/R_h$=2.55. In some embodiments, an inventive trigger group has a ratio of $R_t/R_h<2.5$. In some embodiments, an inventive trigger group has a ratio of $R_t/R_h<2.0$. In some embodiments, an inventive trigger group has a ratio of $R_t/R_h<1.5$. In some embodiments, an inventive trigger group has a ratio of $R_t/R_h<1.2$. In some embodiments, an inventive trigger group has a ratio of $R_t/R_h<1.0$.

In FIG. 20, the hammer interior angle 74 is decreased with respect to the prior art, and the trigger interior angle 76 has been increased. A hammer interior angle 74 of the reference triangle is approximately 43 degrees. A trigger interior angle 76 of the reference triangle is approximately 35 degrees. A ratio of hammer interior angle 74/trigger interior angle 76=approximately 1.23, as compared to the prior art ratio of 3.05. In various embodiments, an inventive trigger group can have a ratio of hammer interior angle 74/trigger interior angle 76 of less than 3, less than 2.5, less than 2, less than 1.5, less than 1.25, less than 1.2, less than 1.1 and less than 1. The change in ratio provides reduces the trigger pull force and the amount of frictional engagement force between the trigger and hammer sears.

Figure 21:
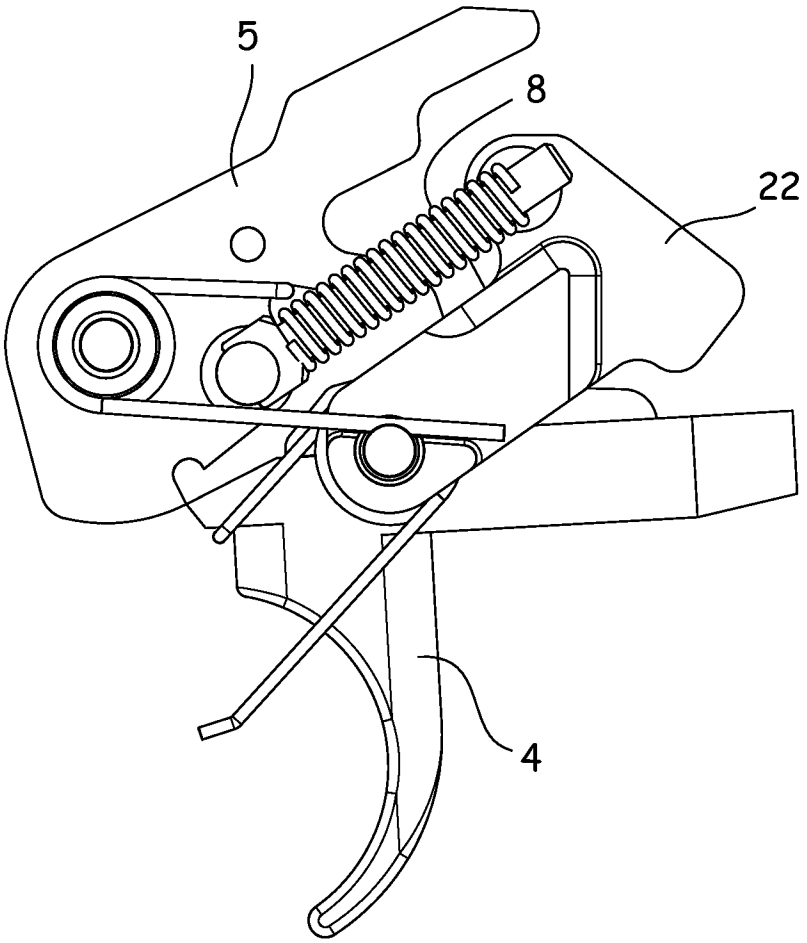
FIG. 21 shows a side view of another embodiment of an inventive trigger group.

FIG. 21 shows an embodiment similar to that of FIG. 20, further comprising a frame 22 and secondary biasing member 8 as herein described.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm trigger group comprising:

a trigger arranged to pivot on a trigger axis;

a hammer arranged to pivot on a hammer axis;

a hammer spring arranged to bias said hammer in a predetermined rotational direction; and a secondary biasing member comprising a secondary biasing spring arranged to bias said hammer;

wherein said hammer is moveable from a first position to a second position upon actuation of said trigger, said secondary biasing member counteracting said hammer spring in said first position, said secondary biasing member cooperating with said hammer spring in said second position.

2. The firearm trigger group of claim 1, wherein said secondary biasing spring comprises a tension spring.

3. The firearm trigger group of claim 2, wherein said secondary biasing member further comprises a mounting shaft, said compression spring supported by said mounting shaft.

4. The firearm trigger group of claim 1, wherein said secondary biasing spring comprises a compression spring.

5. The firearm trigger group of claim 4, wherein said mounting shaft is positioned within said compression spring.

6. The firearm trigger group of claim 1, wherein said secondary biasing member is pivotally engaged with said hammer.

7. The firearm trigger group of claim 1, wherein said secondary biasing spring comprises a first spring and said secondary biasing member comprises a second spring.

8. The firearm trigger group of claim 7, wherein said first and second springs are parallel.

9. The firearm trigger group of claim 7, wherein said first and second springs are balanced on opposite sides of a hammer swing plane.

10. The firearm trigger group of claim 1, further comprising a frame arranged to support said secondary biasing member.

11. The firearm trigger group of claim 10, said frame defining a secondary biasing member pivot axis.

12. The firearm trigger group of claim 10, said frame member engaged to a trigger pivot pin.

13. The firearm trigger group of claim 10, wherein a first end of said secondary biasing member is engaged to said hammer and a second end of said secondary biasing member is engaged to said frame.

14. The firearm trigger group of claim 10, wherein said frame abuts a safety mechanism.

15. The firearm trigger group of claim 1, said hammer comprising a sear arranged to contact said trigger, said sear comprising first and second surfaces separated by a notch.

16. The firearm trigger group of claim 15, wherein a portion of a disconnector passes through said notch as the hammer moves between said first and second positions.

17. The firearm trigger group of claim 1, wherein said secondary biasing mechanism comprises a drive pin engaged to said hammer, a central axis of said drive pin offset from said hammer axis.

18. The firearm trigger group of claim 17, said secondary biasing mechanism comprising a mounting shaft comprising a semicircular surface arranged to abut said drive pin.

19. The firearm trigger group of claim 1, said trigger defining a trigger sear, a distance from said trigger axis to said trigger sear defining a trigger moment arm $R_t$;

said hammer defining a hammer sear, a distance from said hammer axis to said hammer sear defining a hammer moment arm $R_h$;

wherein $R_t/R_h<2$.

20. A firearm trigger group comprising:

a trigger arranged to pivot on a trigger axis;

a hammer arranged to pivot on a hammer axis;

a hammer spring arranged to bias said hammer in a first rotational direction; and a secondary biasing member comprising a secondary biasing spring arranged to bias said hammer;

wherein said hammer is moveable from a first position to a second position upon actuation of said trigger, said secondary biasing member biasing said hammer in a second rotational direction in said first position, said secondary biasing member biasing said hammer in said first rotational direction in said second position.

* * * * *